US005326029A

United States Patent [19]

Schultz

[11] Patent Number: 5,326,029

[45] Date of Patent: Jul. 5, 1994

[54] CONTROL SYSTEM, CONTROL DEVICE THEREFOR AND METHODS OF MAKING THE SAME

[75] Inventor: Gilbert Schultz, Fullerton, Calif.

[73] Assignee: RobertShaw Controls Company, Richmond, Va.

[21] Appl. No.: 102,375

[22] Filed: Aug. 5, 1993

[51] Int. Cl.[5] ..... G05D 15/00; F23D 5/16

[52] U.S. Cl. ..... 236/68 D; 137/66

[58] Field of Search ..... 137/66; 236/68 D, 15 A

[56] References Cited

U.S. PATENT DOCUMENTS

| | | | |
|---|---|---|---|
| 3,090,560 | 5/1963 | Holzboog et al. | 236/68 D |
| 3,507,037 | 4/1970 | Dykzeul | 29/592 |
| 3,508,708 | 4/1970 | Caparone et al. | 236/33 |
| 4,285,662 | 8/1981 | Katchka et al. | 431/53 |

FOREIGN PATENT DOCUMENTS

| | | | |
|---|---|---|---|
| 1279013 | 6/1972 | United Kingdom | 236/15 A |

*Primary Examiner*—William E. Wayner
*Attorney, Agent, or Firm*—Candor, Candor & Tassone

[57] ABSTRACT

A control system, a control device therefor and methods of making the same are provided, the control device having an axially movable shaft for moving a movable valve into its latching position with an electromagnetic unit and also being rotatable from a first position thereof to a second position thereof to place and hold an electrical switch in an operating condition thereof, the switch being in series with the electromagnetic unit so that the electromagnetic unit can not have an electrical current flowing therethrough unless the switch is in the operating condition thereof.

20 Claims, 4 Drawing Sheets

CONTROL SYSTEM, CONTROL DEVICE THEREFOR AND METHODS OF MAKING THE SAME

BACKGROUND OF THE INVENTION

1. Field of the Invention

This invention relates to a new control system, such as a control system for a water heater, and to a new control device for such a system as well as to a new method of making such a control system and to a new method of making such a control device.

2. Prior Art Statement

It is known to provide a control device comprising a housing means, an electromagnetic means carried by the housing means, a movable valve means carried by the housing means and normally being disposed in a first operating position thereof and being adapted to be held in a second operating position thereof by the electromagnetic means as long as the electromagnetic means remains energized, electrical switch means carried by the housing means and being operatively interconnected to the electromagnetic means so that the electromagnetic means is adapted to be energized when the switch means is in a first operating condition thereof and is prevented from being energized when the switch means is in a second operating condition thereof, and a shaft means carried by the housing means and being adapted to be axially moved from a first position thereof to a second position thereof so as to engage the valve means and move the valve means from the first operating position thereof to the second operating position thereof. For example, see the U.S. Pat. Nos. 4,285,662, to Katchka et al, 3,508,708 to Caparone et al, and 3,507,037 to Dykzeul.

In one such prior known control device, the plug valve member of the control device when rotated to a certain position thereof closed such an electrical switch means.

It is also known to provide a control device comprising a housing means, an electromagnetic means carried by the housing means, a movable valve means carried by the housing means and normally being disposed in a first operating position thereof and being adapted to be held in a second operating position thereof by the electromagnetic means as long as the electromagnetic means remains energized, a pressure regulator valve means carried by the housing means, and a shaft means carried by the housing means and being adapted to be axially moved from a first position thereof to a second position thereof so as to engage the movable valve means and move the movable valve means from the first operating position thereof to the second operating position thereof. For example, see the aforementioned U.S. Pat. No. 3,508,708 to Caparone et al.

SUMMARY OF THE INVENTION

It is one of the features of this invention to provide a new control device wherein the axially movable shaft means thereof that is normally utilized to move a valve means into its latching position with an electromagnetic means of the control device is utilized in an unique manner to control one or more operating means of the control device.

In particular, it has been found according to the teachings of this invention that an electrical switch means can be carried by the housing means of the control device and be operatively interconnected to the electromagnetic means so that the electromagnetic means is adapted to be energized when the switch means is in a first operating condition thereof and is prevented from being energized when the switch means is in a second operating condition thereof, the axially movable shaft means being provided with actuator means that is operatively interconnected to the switch means and being rotatably movable from a first rotatable position thereof to a second rotatable position thereof to place and hold the switch means in the second operating condition thereof.

For example, one embodiment of this invention comprises a control device comprising a housing means, an electromagnetic means carried by the housing means, a movable valve means carried by the housing means and normally being disposed in a first operating position thereof and being adapted to be held in a second operating position thereof by the electromagnetic means as long as the electromagnetic means remains energized, electrical switch means carried by the housing means and being operatively interconnected to the electromagnetic means so that the electromagnetic means is adapted to be energized when the switch means is in a first operating condition thereof and is prevented from being energized when the switch means is in the second operating condition thereof, and a shaft means carried by the housing means and being adapted to be axially moved from a first position thereof to a second position thereof so as to engage the valve means and move the valve means from the first operating position thereof to the second operating position thereof, the shaft means having actuator means operatively interconnected to the switch means and being rotatably movable from a first rotatable position thereof to a second rotatable position thereof to place and hold the switch means in the first operating condition thereof.

It was also found according to the teachings of this invention that such a shaft means can be utilized to control a pressure regulator valve means of the control device by causing the pressure regulator valve means to be held in a closed condition as long as the shaft means is in a first rotatable position thereof and to permit the pressure regulator valve means to be in an operating condition thereof when the shaft means is rotated to a second rotatable position thereof.

For example, another embodiment of this invention comprises a control device comprising a housing means, an electromagnetic means carried by the housing means, a movable valve means carried by the housing means and normally being disposed in a first operating position thereof and being adapted to be held in a second operating position thereof by the electromagnetic means as long as the electromagnetic means remains energized, a pressure regulator valve means carried by the housing means, and a shaft means carried by the housing means and being adapted to be axially moved from a first position thereof to a second position thereof so as to engage the movable valve means and move the movable valve means from the first operating position thereof to the second operating position thereof, the shaft means having actuator means operatively interconnected to the pressure regulator valve means and being rotatably movable from a first rotatable position thereof that holds the pressure regulator valve means in a closed condition thereof to a second rotatable position thereof that places the pressure regulator valve means in an operating condition thereof.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Another object of this invention is to provide a new control system utilizing such a control device, the system of this invention having one or more of the novel features of this invention as set forth above or hereinafter shown or described.

Another object of this invention is to provide a new method of making such a control system, the method of this invention having one or more of the novel features of this invention as set forth above or hereinafter shown or described.

Other objects, uses and advantages of this invention are apparent from a reading of this description which proceeds with reference to the accompanying drawings forming a part thereof in wherein:

DESCRIPTION OF THE PREFERRED EMBODIMENT

Figure 1:
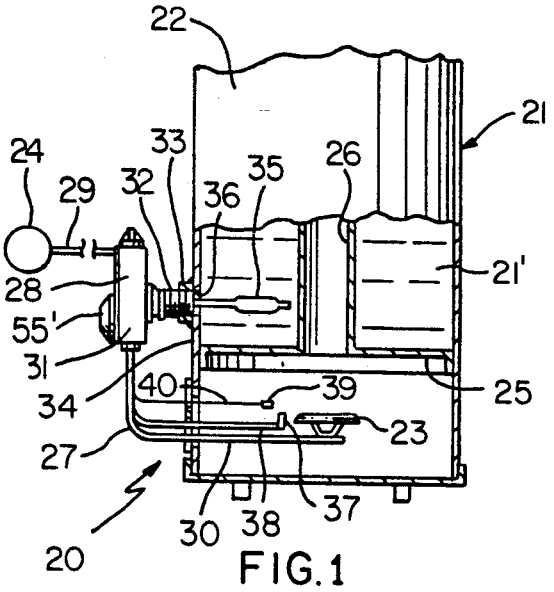
FIG. 1 is a schematic view illustrating the control system of this invention for controlling the operation of a water heater.

While the various features of this invention are hereinafter illustrated and described as being particularly adapted to provide a control system for a water heater, it is to be understood that the various features of this invention can be utilized singly or in various combinations thereof to provide a control system for other apparatus as desired.

Therefore, this invention is not to be limited to only the embodiment illustrating in the drawings, because the drawings are merely utilized to illustrate one of the wide variety of uses of this invention.

Referring now to FIG. 1, the new control system of this invention is generally indicated by the reference numeral 20 and is being utilized to control a water heater that is generally indicated by the reference numeral 21 in FIG. 1 and comprises a tank 22 for containing water 21' therein and a main burner means 23 for receiving fuel, such as natural or synthetic gas, from a source 24 and issuing the fuel therefrom so as to burn and heat the tank 22 and, thus, the water 21' therein by conduction in a manner well known in the art.

The tank 22 has a bottom wall means 25 and a flue passage 26 extending upwardly from a central area of the bottom wall means 25 for conveying away combustion products of the burner means 23 also in a manner well known in the art.

The fuel from the source 24 is directed to the burner means 23 by a conduit means 27 under the control of a control device 28 of this invention that is disposed intermediate the source 24 and the burner means 23 so that a first portion 29 of the conduit means 27 leads from the source 24 to the control device 28 and a second portion 30 of the conduit means 27 leads from the control device 28 to the burner means 23 in a manner well known in the art.

The control device 28 comprises a housing means 31 having an externally threaded shank portion 32 threaded into an internally threaded spud 33 carried on a wall 34 of the tank 22 and permitting a temperature sensing rod and tube unit 35 of the control device 28 to project through an opening 36 in the wall 34 of the tank 22 so as to be disposed in the water 21' in the tank 22 while the control device 28 is held in the position illustrated in FIG. 1 by the threaded interconnection between the shank 32 and the spud 33 all in a manner well known in the art.

The system 20 of this invention includes a pilot burner means 37 disposed adjacent the main burner means 23 and being supplied fuel from the control device 28 through a conduit means 38 in a manner hereinafter set forth.

In addition, the control system 20 of this invention includes a flame detecting means 39 disposed adjacent the pilot burner means 37 and being interconnected to the control device 28 by electrical conductor means 40 also in a manner well known in the art.

In general, the parts of the system 20 previously described are well known in the art. For example, see the aforementioned U.S. Pat. Nos. 4,285,662 to Katchka et al, the aforementioned U.S. Pat. No. 3,508,708 to Caparone et al, and the aforementioned U.S. Pat. No. 3,507,307 to Dykzeul whereby these three U.S. patents are being incorporated into this disclosure by this reference thereto.

Therefore, a detailed discussion of the structure and the operation of the various parts of the system 20 is deemed unnecessary. However, sufficient details of such prior known structure will be hereinafter set forth in order to fully understand the various features of this invention.

Referring now to FIGS. 3-9, the housing means 31 of the control device 28 has an inlet 41 for interconnecting to the portion 29 of the conduit means 27 that leads from the fuel source 24 and an outlet 42 for interconnecting to the portion 30 of the conduit 27 that leads to the burner means 23, the-housing means 31 having another outlet 43 for interconnecting to the conduit 36 that leads to the pilot burner means 37.

While the housing means 31 can be formed of any suitable material, the same comprises metallic material suitably cast and machined as is well known in the art.

Figure 6:
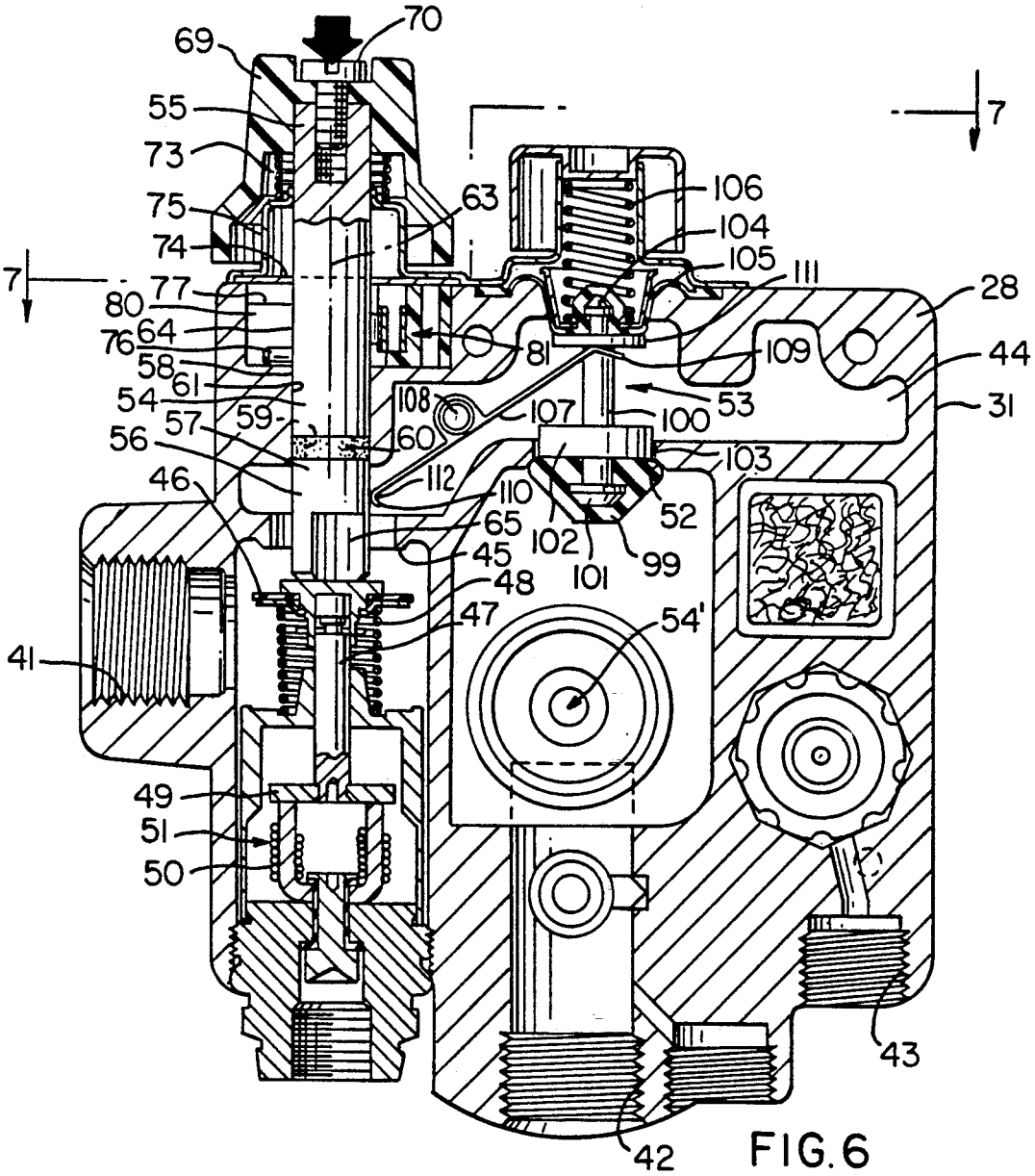
FIG. 6 is a view similar to FIG. 3 and illustrates the control device set in the "pilot light" position thereof.
Figure 9:
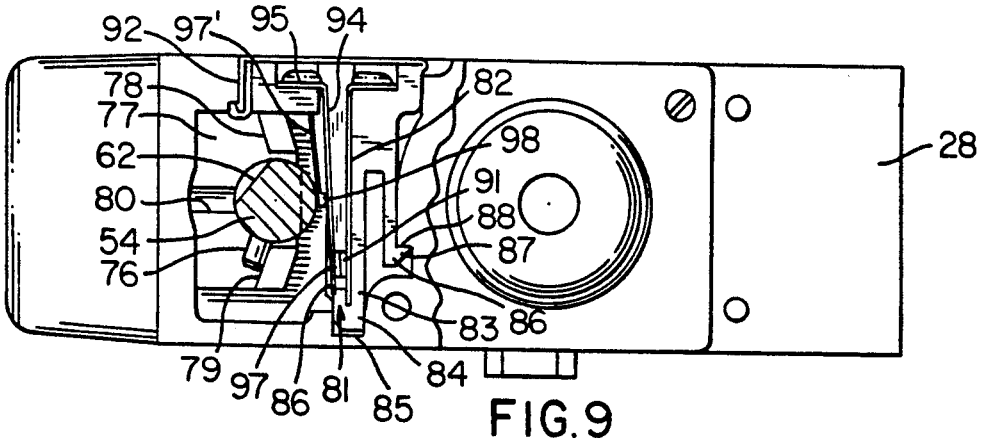
FIG. 9 is a top cross-sectional view of the control device of FIG. 8 and is taken generally in the direction of the arrows 9—9 of FIG. 8.
Figure 8:
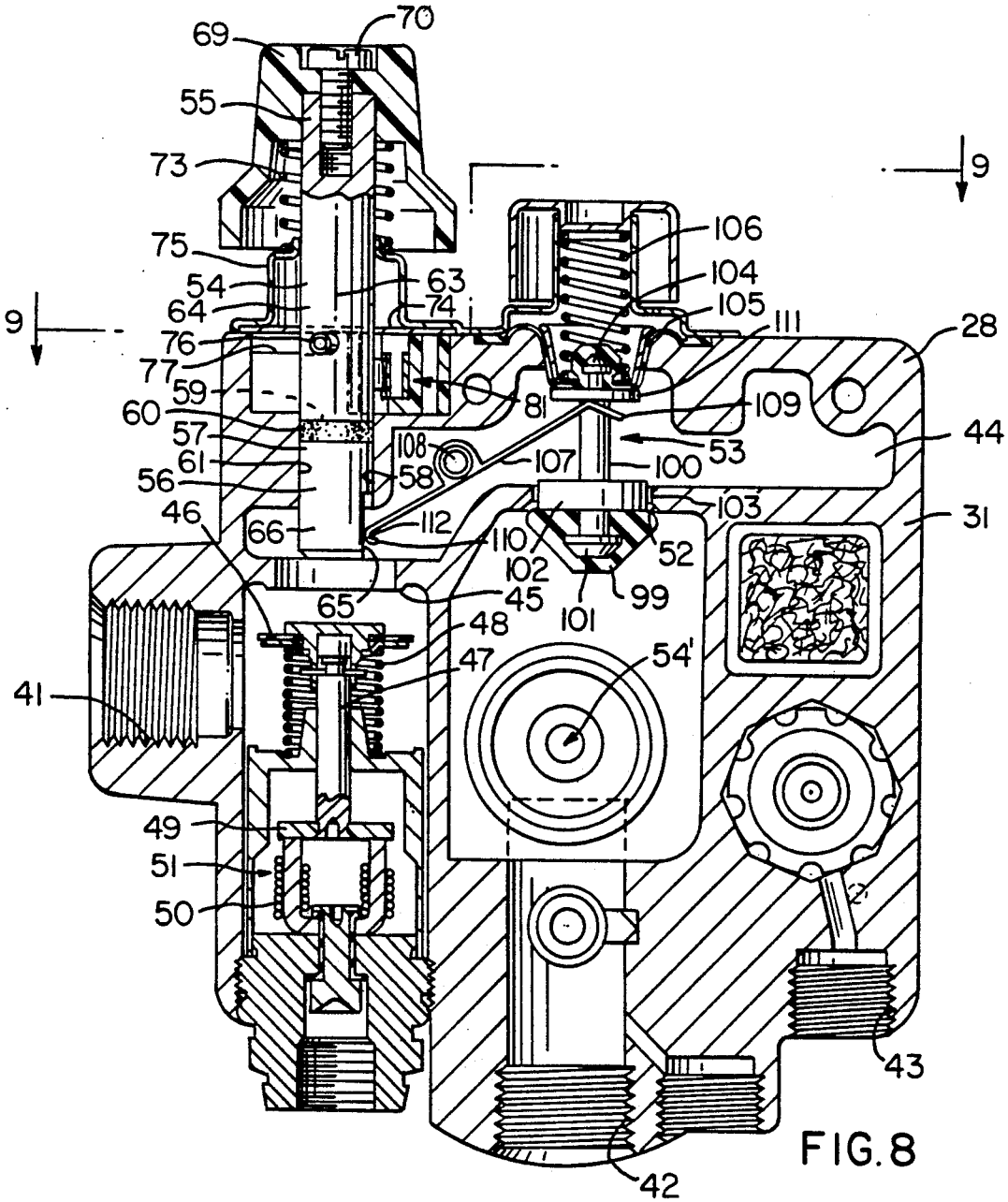
FIG. 8 is a view similar to FIG. 6 and illustrates the control device in the "on" condition thereof.

The housing means 31 of the control device 28 has a chamber 44 separated from the inlet 41 by a valve seat 45 that is controlled by a movable valve member 46 that is carried on a stem 47 and that is normally urged to a closed position against the valve seat 45 by a compression spring 48, the stem 47 carrying an armature 49 that is adapted to be held in a latched position as illustrated in FIG. 6 and 8 when an electrical current passes through a coil means 50 of an electromagnetic means 51 carried in the housing means 31 all in a manner well known in the art. However, when the current ceases to flow through the coil means 50 of the electromagnetic means 51, the compression spring 48 moves the valve member 46 to its closed condition against the valve seat 45 preventing the inlet 41 from being interconnected to the chamber 44.

The chamber means 44 of the housing means 31 of the control device 28 is directly interconnected to the pilot outlet 43 through suitable passages in the housing means 28 so that as long as the movable valve means 46 is in an open condition, fuel is adapted to flow from the source 24 to the pilot burner means 37. However, the chamber 44 of the housing means 31 of the control device 28 is interconnected to the main outlet 42 first through a valve seat 52 of a pressure regulator valve means 53 and then through a temperature controlled valve means 54'0 in a manner well known in the art.

In particular, the rod and tube temperature sensing means or unit 35 previously described controls the valve means 54' so that when the temperature of the water 21' in the tank 22 falls below a temperature setting of the control device 28, such as being selected by a person setting the control knob 55' of the control device 28 as illustrated in FIG. 1, of FIG. 1 in a manner well known in the art, the temperature sensing means 35 opens the valve means 54' so that pressure regulated fuel is now adapted to pass to the main burner means 23 to be ignited by the pilot burner 37 and thereby heat the water 21' in the tank 22 until the temperature sensing means 35 Senses that the temperature of the water 21' in the tank 22 has risen to or above the selected temperature and causes the valve means 54' to close.

As is well known in the prior art, the flame detecting means 39 that detects flame at the pilot burner means 37 comprises a thermocouple that will generate an electrical current flow through the coil means 50 of the electromagnetic means 51 as long as a flame appears at the pilot burner means 37 as fully disclosed in the aforementioned U.S. Pat. No. 4,285,662 Katchka et al.

Therefore, some means must be provided to move the valve means 46 to its open condition and its latching position as illustrated in FIG. 6 so that fuel can flow to the pilot burner means 37 to be ignited either manually or automatically so that the thus burning pilot burner means 37 will cause the thermocouple 39 to generate an electrical current to flow through the coil means 50 and thereby hold the armature 49 of the valve means 46 in its open condition.

Such means of this invention comprises an unique shaft means 54 having opposed ends 55 and 56 and an intermediate substantially cylindrical section 57 that is adapted to move axially upwardly and downwardly in a cylindrical opening 58 in the housing means 31 of the control device 28 while being rotatable therein as will be apparent hereinafter, the shaft means 54 having an annular groove 59 in the cylindrical section 57 thereof and containing an annular O-ring sealing member 60 which seals against an internal peripheral surface 61 of the housing means 31 that defines the opening 58. The end 55 of the shaft 54 has a flat surface 62 that is disposed closer to a longitudinal axis 63 of the shaft 54 than the remaining arcuate surface means 64 of the end 55. Likewise the end 56 of the shaft 54 has a flat surface 65 that is disposed closer to the longitudinal axis 63 than the remainder of the arcuate surface 66 of the end 56. Thus, the end 55 of the shaft 54 comprises a first cam means or actuator means 67 and the end 56 of the shaft 55 comprises a second cam means or actuator means 68 whereby the cam means 67 and 68 of the shaft are uniquely utilized to respectively control other operating structure of the control device 28 as will be apparent hereinafter.

A control knob 69 is carried on the end 55 of the shaft 54 and is fastened thereto by a threaded fastening member 70 as illustrated, the knob 69 having a D-shaped opening 71 formed in a surface 72 thereof to receive the end 55 of the shaft 54 therein whereby the cam means 67 of the shaft 54 cooperates with the opening 71 so that rotation of the knob 69 causes like rotation of the shaft 54.

Figure 4:
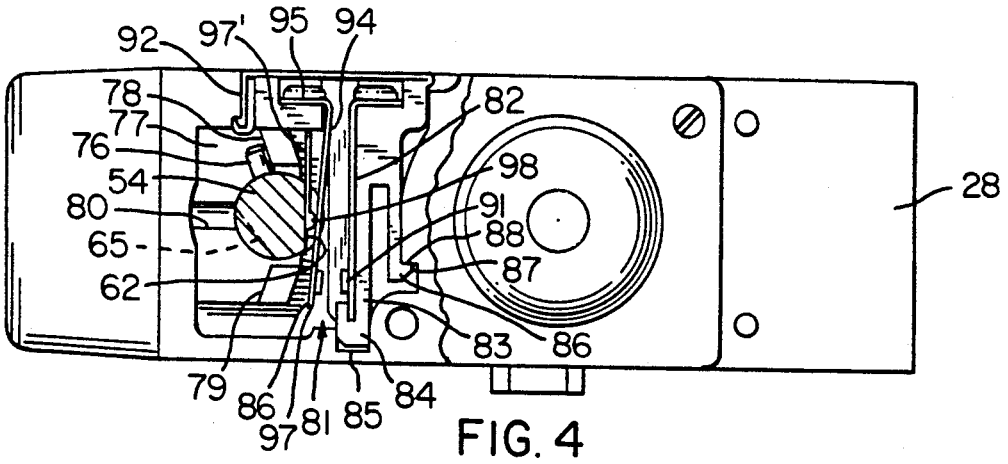
FIG. 4 is a top cross-sectional view of the control device of FIG. 3 and is taken generally in the direction of the arrows 4—4 of FIG. 3.
Figure 3:
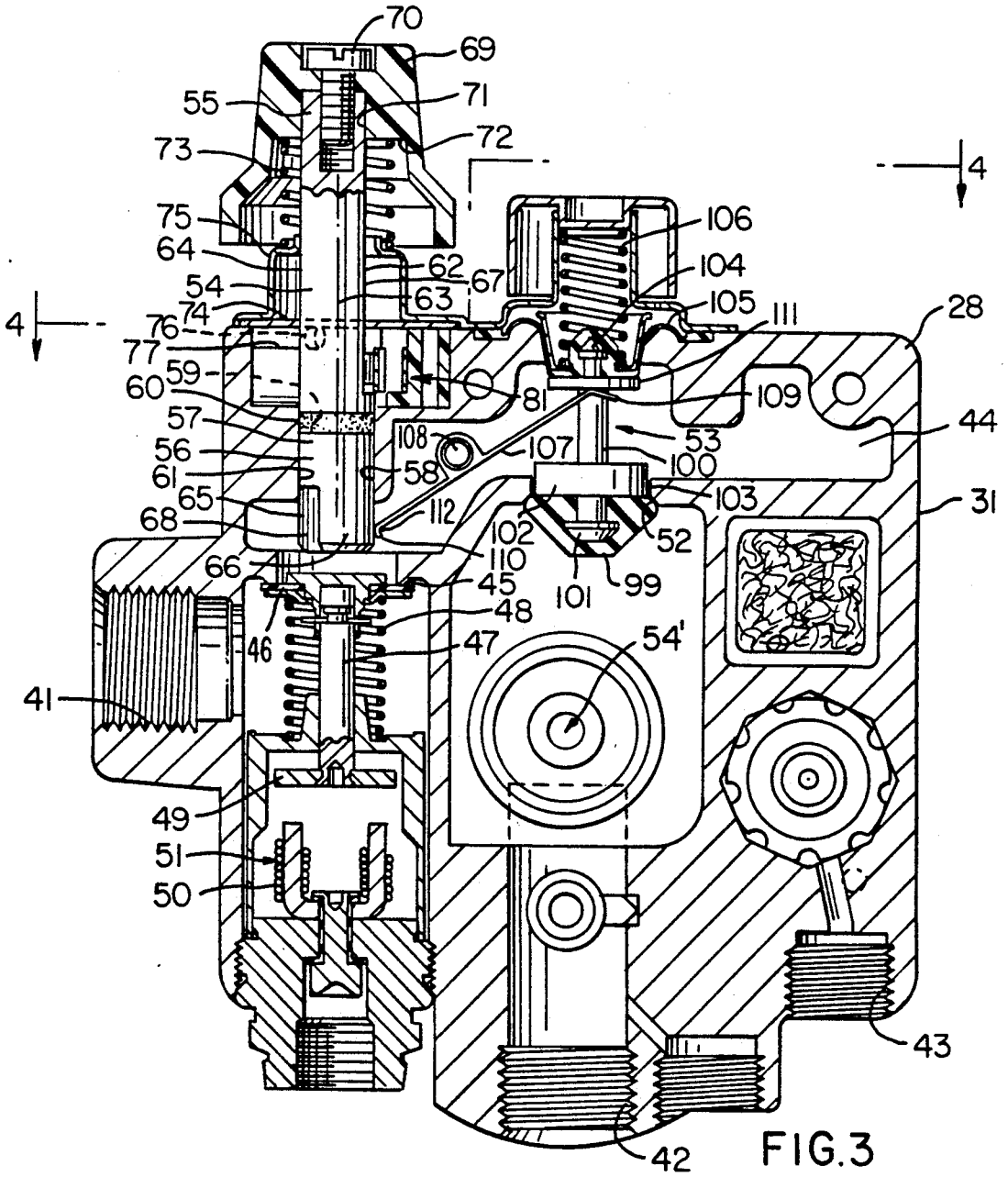
FIG. 3 is an enlarged cross-sectional view of the control device of this invention that is utilized in the system of FIG. 1, the control device of FIG. 3 being disposed in its "off" condition.
Figure 7:
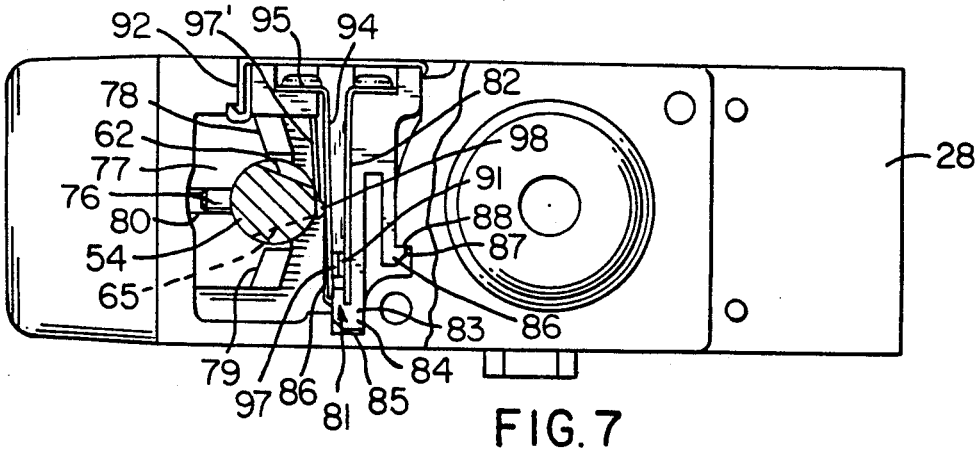
FIG. 7 is a top cross-sectional view of the control device of FIG. 6 and is taken generally in the direction of the arrows 6—6 thereof.

A compression spring 73 is carried by the housing means 31 and acts against the surface 72 of the control knob 69 to tend to hold the shaft 54 in its up position wherein a pin means 76 of the shaft 54 engages against a washer-like member 74 held against the housing means 31 by a secured cover means 75 of the housing means 31 to prevent the shaft 54 from being pulled out of the opening 58 whereby the normal axial position of the shaft 54 is in the out axial position as illustrated in FIGS. 3 and 4. Of course, another pin or other structure could be utilized for this purpose.

Figure 5:
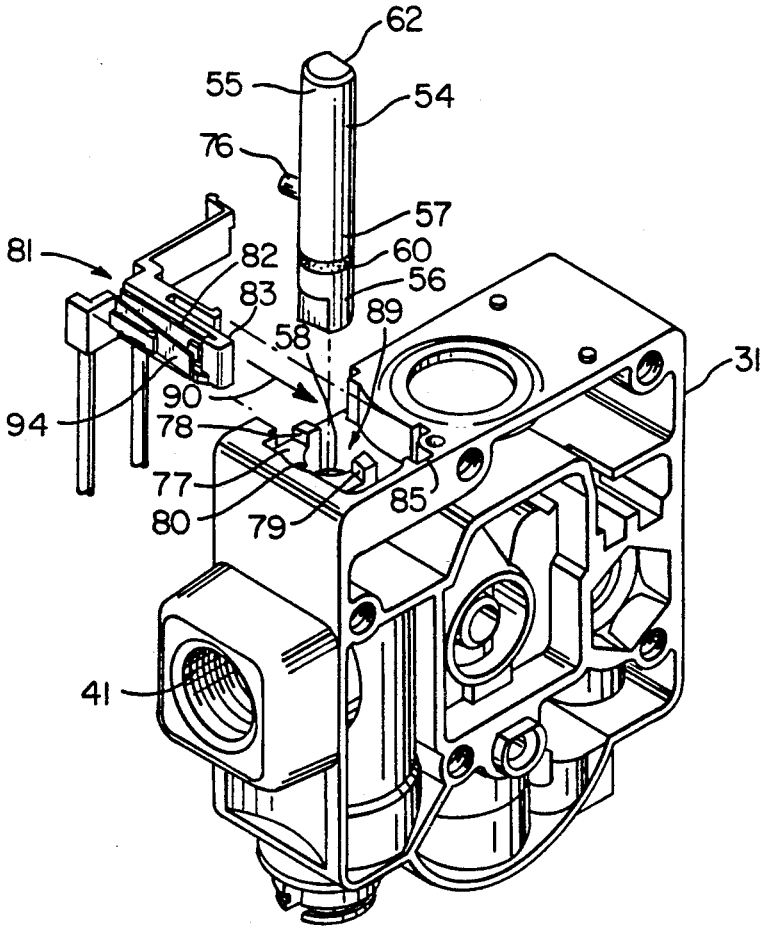
FIG. 5 is a broken away exploded perspective view illustrating certain of the parts of the control device illustrated in FIG. 3.

The pin 76 is carried by the shaft 54 and extends outwardly therefrom as illustrated in FIG. 5 to cooperate with a surface 77 on the housing means 31 of the control device 28 so as to be movable between a first stop 78 that extends upwardly from the surface 77 to a second stop 79 that also extends upwardly from the surface 77 whereby rotational movement of the shaft 54 is controlled by the stops 78 and 79 as will be apparent hereinafter.

The surface 77 of the housing means 31 of the control device 28 is interrupted by a slot 80 substantially intermediate the stops 78 and 79 with the slot 80 extending downwardly into the housing means 28 so as to permit the shaft 54, when its pin 76 is aligned with the slot 80, to be moved axially downwardly by the operator pushing down on the control knob 69 in opposition to the force of the compression spring 73 so that the end 56 of the shaft 54 can engage against the movable valve means 46 and move the same downwardly therewith in opposition to the force of its compression spring 48 to the latching position illustrated in FIG. 6 whereby the now opened valve seat 45 permits fuel to flow to the chamber 44 and, thus, out of the pilot outlet 43 to the pilot burner 37. Thus, it can be seen that when the shaft 54 has been rotated so that the pin 76 is aligned with the slot 80, the shaft 54 is in its "pilot" position and once the shaft 54 has been pushed axially downwardly to open the valve means 46, the shaft 54 is in its "pilot light" position.

The cam means 67 of the shaft 54 of the control device is uniquely utilized to control an electrical switch means of this invention that is generally indicated by the reference numeral 81 in FIGS. 4, 5, 7 and 9.

While the switch means 81 can have any suitable configuration, the embodiment thereof illustrated in the drawings comprises a first metallic switch blade 82 held in a fixed position by a support means 83 that is formed of electrically insulating material, such as plastic material, and having a first portion 84 for being disposed in a notch 85 in the housing means 31 of the control device 28 while a second portion thereof 86 is adapted to have a lip 87 thereof snapped over a ledge 88 of the housing means 31 to snap-fittingly hold the switch means 81 in its assembled relation in the housing means 31 when the switch means 81 is pushed inwardly into a cooperating cavity 89 formed in the housing means 31 and in the direction of the arrow 90 as illustrated in FIG. 5.

The switch blade 82 has a fixed contact 91 for interconnecting into the electrical circuit means of this invention that is generally indicated by the reference numeral 93 in FIG. 2 and hereinafter described, a part 92 of the support means 83 being subsequently bent and snap-fit into position as illustrated in FIG. 4.

The support means 83 of the electrical switch means 81 carries a second metallic blade 94 that has one end 95 fixed to the support means 83 while the other end 96 of the switch blade 94 is movable relative thereto and carries a contact means 97 for cooperating with the contact means 91, the switch blade 94 having a natural bias to tend to hold the contact 97 away from the contact 91.

The support means 83 of the electrical switch means 81 includes a flexible cantilevered member 97' that is formed of the electrically insulting material and has a projection 98 for engaging against the switch blade 94. The member 97' is disposed in the position illustrated in FIG. 4 wherein the switch blade 94 is against the projection 98 with the contact 97 out of electrical contact with the contact 91 so that the switch means 81 is in an open condition thereof, the member 97' resting against the flat side 62 of the cam means 67 of the shaft 54 when the shaft 54 is disposed in the "off" rotatable position thereof where the pin 76 of the shaft 54 is against the stop 78 as illustrated in FIG. 4. However, when the shaft 54 is rotated from the "off" position toward the "pilot" position wherein the pin 76 will align with the slot 80, the large arcuate surface 64 of the cam means 67 has caromed against the member 97' to cause the same to move to the right in the drawings and carry the switch blade 94 therewith so that the contact 97 is placed in electrical contact with the contact 91 to thereby close the switch means 81 and hold the same in the closed condition thereof as long as the shaft 54 has been rotated out of the "off" position thereof for a purpose hereinafter described. Of course, when the shaft 54 is rotated back to the "off" position thereof where the pin 76 of the shaft 54 is against the stop 78, the flat side 62 of the cam means 67 is now positioned adjacent the member 97' so that the natural resiliency of the member 97' and the switch blade 94 are such that the same can move back to the left as illustrated in FIG. 4 to open the switch means 81 which will always be in an open condition thereof when the shaft means 54 is disposed in the "off" position thereof. In this manner, it can be seen that the cam means 67 acts as an actuator means for controlling the switch means 81.

The cam means 68 of the shaft 54 also acts as an actuator means for the pressure regulator valve means 53 of the control device 28 so that when the shaft 54 is disposed in the "off" position thereof, in the "pilot" position thereof and in the "pilot light" position thereof, a valve member 99 of the pressure regulator valve means 53 is held closed against the valve seat 52 to prevent the fuel from the chamber 44 of the housing means 31 of the control device 28 from reaching the temperature controlled valve means 54' and, thus, to prevent any fuel flow to the main burner means 23. However, when the shaft 54 has been rotated to the "on" position thereof wherein the pin 76 is against the stop 79, the valve member 99 of the pressure regulator valve means 53 is no longer held against the valve seat 52 so that the pressure regulator valve means 53 is disposed in an operating position thereof for controlling the pressure of the fuel that is now permitted to flow through the valve seat 52 to the valve means 54' as will be apparent hereinafter.

The pressure regulator valve means 53 comprises a valve stem 100 that has an end 101 carrying the valve member 99 and a flow controller 102 adjacent the valve member 99, the flow controller 102 being adapted to be disposed in the valve seat passage 103 and thereby control the flow of fuel through the valve seat 52 in a manner well known for pressure regulator valves.

The stem 100 of the pressure regulator valve means 53 has another end 104 carried by a flexible diaphragm 105 that is normally urged toward the valve sear 52 by a compression spring 106 so that the force of the compression spring 106 normally tends to maintain the valve member 99 in an open condition relative to the valve seat 52. The force of the compression spring 106 is adjustable so as to set the pressure valve for the fuel that is permitted to flow through the valve seat 52 in a manner well known in the art.

However, a lever 107 is pivotally mounted to the housing means 31 of the control device 28 by a pivot means 108 located intermediate opposed ends 109 and 110 of the lever 107, the end 109 of the lever 107 engaging against a disc 111 of the stem 100, such as by having the end 109 bifurcated and straddling the stem 100 intermediate the disc 111 and the flow controller 102, and the end 110 being bent to define a cam follower surface 112 engaging against the cam means 68 of the shaft 54 as illustrated in the drawings.

In this manner, the arcuate large surface 66 of the cam means 68 of the shaft 54 when disposed against the surface 112 of the lever 107 pivots the lever 107 in such a manner that the end 109 of the lever 107 moves the stem 100 upwardly against the force of the compression spring 106 to hold the valve member 99 fully seated against the valve seat 52 to thereby prevent a flow of fuel through the valve seat 52 whereby the pressure regulator valve means 53 is disposed in a closed condition thereof. Thus, it is only when the shaft 54 is rotated to the "on" position thereof that the low or flat side of the cam means 68 is disposed adjacent the follower surface 112 of the lever 107 so that the spring means 106 of the pressure regulator valve means 53 can move the diaphragm 105 downwardly and thereby pivot the lever 107 to place the cam follower surface 112 against the flat side 65 of the shaft 54 and thereby permit the valve member 99 to move away from the valve seat 52 as illustrated in FIG. 8. Of course, rotation of the shaft 54 out of the "on" position thereof toward the "pilot" position thereof causes the high side 66 of the cam means 68 to operate on the end 110 of the lever 107 to close the valve member 99 against the valve seat 52 in opposition to the force of the compression spring 106 for a purpose hereinafter described.

Figure 2:
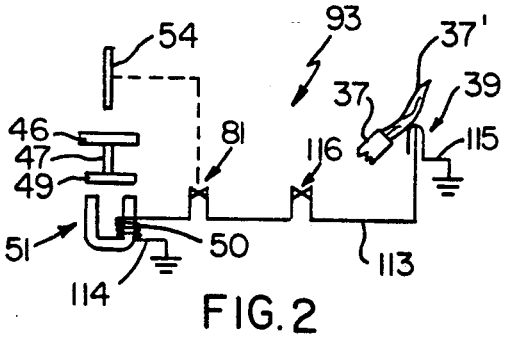
FIG. 2 is a schematic view illustrating the electrical system for the control system of FIG. 1.

As schematically illustrated in FIG. 2, the electrical circuit means 93 for the system 20 of this invention has one part of the thermocouple 39 connected to one end of the coil 50 of the electromagnetic means 51 by a conductor means 113 whereas the other end of the coil 50 is interconnected to ground by a conductor means 114 and the other part of the thermocouple 39 is interconnected to ground by a conductor means 115. The switch means 81 of the control device 28 previously described is disposed in the conductor means 13 intermediate the thermocouple 39 and the coil 50 so as to be in series therewith so that when the switch means 81 is disposed in an open condition the coil means 50 can not be energized by the thermocouple 39. In addition, a conventional temperature operated switch means 116 is also disposed in the conductor means 113 so as to be in series with the thermocouple 39 and the coil means 50 as that if the switch means 116 is in an open condition thereof, the coil means 50 cannot be energized, the switch means 116 being located in the temperature sensing means or unit 35 and being adapted to open should the same sense the temperature of the water 21' in the tank 22 being approximately 200° F. Such temperature operated switch means is fully disclosed in the aforementioned U.S. Pat. No. 3,507,037 to Dykzeul.

From the above, it can be seen that the control system 20 and the control device 28 of this invention can each be made in a simple and effective manner by the method of this invention previously described so as to operate in a manner now to be described.

With the control knob 69 of the control device 28 disposed in the "off" condition wherein the pin 76 of the shaft 54 is disposed against the stop 78, as illustrated in FIGS. 3 and 4, not only is the valve means 46 being held against its valve seat 45 by the compression spring 48, but also the high side 66 of the cam means or actuator means 68 of the shaft 54 is engaging the follower surface 112 of the lever 107 so as to hold the lever 107 in a counter clockwise direction to maintain the valve member 99 of the pressure regulator valve means 53 in its closed condition against the valve seat 52 in opposition to the force of the compression spring 106 so that no fuel from the source 24 can pass to either of the burner means 23 and 37, the valve member 46 preventing any flow of fuel to the pilot burner means 37 and the redundancy of the two valve means 46 and 53 in series preventing any flow of fuel to the main burner means 23. In addition, the flat side 62 of the cam means 67 of the shaft 54 is adjacent the member 97 of the switch means 81 so that the switch means 81 is in the open condition thereof to prevent any flow of elective current through the coil 50.

Should it be desired to operate the control system 20 so as to heat the water 21' in the tank 22 of the water heater 21, the operator selects the desired temperature for the water 21' by adjusting the control knob 55' to the desired temperature setting thereof and then rotates the control knob 69 to the "pilot" position thereof wherein the pin 76 of the shaft 54 is located over the slot 80 in the surface 77 of the housing means 31. Such rotation of the shaft 54 still does not bring the flat area 65 of the cam means 68 of the shaft 54 adjacent the follower surface 112 of the lever 107 so that the valve member 99 of the pressure regulator valve means 53 remains in its closed condition whereas the flat surface 62 of the cam means 67 of the shaft 54 is now moved away from the actuator member 97' of the electrical switch means 81 and places the high side 64 of the cam means 67 against the actuator member 97' to move the actuator member 97' and the switch blade 94 to the right in the drawings to place the contact 97 against the contact 91 and thereby hold the switch means 81 in the closed condition thereof so as to permit electrical current to flow through the coil means 50 once the thermocouple 39 detects a flame at the pilot burner means 37, such as flame 37' in FIG. 2.

When the shaft 54 has been rotated to the "pilot" position previously described, the operator then pushes axially downwardly on the same in the manner illustrated in FIG. 6 to engage against the valve means 46 and move the valve means 46 away from the valve seat 45 in opposition to the force of the compression spring 48 to not only open the valve seat 45, but also to place the ,armature 49 closely adjacent the electromagnetic means 51 so that when a current flows through the coil means 50 of the electromagnetic means 51, the armature 49 will be held in such position of FIG. 6 in opposition to the force of the compression spring 48 even though the shaft 54 is subsequently permitted to move upwardly away from the valve means 46.

With the control device 28 now set in the "pilot light" condition illustrated in FIG. 6, the operator lights the fuel now flowing out of the burner means 37 since the fuel can pass through the open valve seat 45 and chamber 44 to the pilot outlet means 43 as previously stated. When a flame 37' FIG. 2 is created at the pilot burner means 37, it can be seen that because the switch means 81 and 116 are each in the closed condition thereof, electrical current created by the thermocouple 39 can now flow through the coil means 50 and such current will continue to flow through the coil means 50 as long as the flame 37' remains at the pilot burner means 37.

The creation of the current flow through the coil 50 of the electromagnetic means 51 causes the armature 49 of the valve means 46 to now be held in a position of FIG. 6 so that the operator can release his force pushing downwardly on the knob 69 so that the knob 69 can now return to its fully up position wherein the pin 76 of the shaft 54 engages the washer 74 of the housing means 28 under the force under the compression spring 73 so that the pin 76 of the shaft 54 is now above the surface 77 of the housing means 31 at the slot 80. With the shaft 54 now in this "pilot" position, the pilot burner 37 will continue to have fuel directed thereto as the valve means 46 is being held in an open condition by the electromagnetic means 51.

The operator then rotates the control knob 69 to the "on" position of the shaft 54 wherein the pin 76 is disposed against the stop 79 and before the pin 76 reaches the stop 79, the low or flat surface 65 of the cam means 68 is now positioned adjacent the follower surface 112 of the lever 107 so that the lever 107 can pivot in a clockwise direction to place the follower surface 112 against the flat surface 65 under the force of the compression spring 106 moving the stem 100 of the valve member 99 downwardly as illustrated in FIG. 8 to remove the holding force that the lever 107 previously placed on the valve member 99 to close the same against the valve seat 52 so that the pressure regulator valve means 53 is now operative to control the pressure of the fuel that is now permitted to pass through the valve seat 52 to reach the valve means 54'. Also, it can be seen that the switch means 81 remains closed with the shaft in its "on" position.

If the temperature of the water 21' in the water tank 22 is at this time below the temperature selected by the knob 55', the rod and tube temperature sensing means 35 will have opened the valve means 54' to permit fuel to flow to the main burner means 23 to be ignited by the pilot burner means 37 so that the fuel now burning at the main burner means 23 will heat the water 21' in the tank 22 by conduction. When the temperature of the water 21' subsequently reaches the temperature selected by the knob 55', the rod and tube temperature sensing means 35 will close the valve means 54' to terminate the flow to the burner means 23.

Thus, the rod and tube temperature sensing means 35 will open and close the valve means 54' in a manner well known in the art to tend to maintain the temperature of water 21' in the water tank 22 at the temperature selected by the control knob 55'.

As previously stated, should the temperature of the water 21' in the tank 22 for some reason reach the high limit temperature condition for operating the switch means 116, such as through a runaway condition of the burner means 23, the switch means 116 will open and thereby terminate the the flow of current through the coil means 50 of the electromagnetic means 51 so that the compression spring 48 will close the valve member 46 against the valve seat 45 to terminate the flow of fuel to the burner means 23 as well as to the pilot burner means 37 requiring a subsequent relighting of the pilot burner means 37 in the manner previously described once the switch means 116 closes.

If for some reason, the operator wants to turn off the system 20, the operator can rotate the control knob 69 of the shaft 54 back to the "off" position wherein the pin 76 of the shaft 54 is disposed against the stop 78 and under such condition, the switch means 81 will be opened by the cam means 67 in the manner previously described and the valve member 99 of the pressure regulator valve means 53 will be held against the valve seat 52 by the cam means 68 in the manner previously described so that the opening of the switch means 81 causes the electrical current to cease to flow through the coil means 50 whereby the valve member 46 will be closed against the valve seat 45 by the spring 48 to terminate the flow of fuel to the pilot burner means 37 and thereby terminate the flame 37' while the closing of the valve member 99 of the pressure regulator valve means 53 as well as the closing of the valve member 46 against the valve seat 45 terminates the flow of fuel to the main burner means 23.

While the description and operation of the system 20 and control device 28 of this invention previously described has provided a pilot burner means 37 for the main burner means 23, it is to be understood that the pilot burner means 37 could be eliminated and that a small flame can be provided at the main burner means 23 when the shaft 54 is moved axially downwardly in its "pilot light" position as the small flow of fuel normally out of the outlet means 43 to the pilot burner means could be directed by the housing means 28 to the main burner means 23 whereby the flame detecting means 39 will detect the small flame at the main burner means 23 which will thereafter have a full flow of fuel thereto when the shaft 54 is rotated to the "on" position for the reasons previously set forth.

Therefor, it can be seen that this invention not only provides a new control system and a new control device therefor, but also this invention provides a new method of making such a control system and a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention , in the portion of each claim that is disposed after the terms "the improvement" whereby it is belived that each claim sets forth a novel, useful and unobvious invention within the purview of the Patent Statute.

What is claimed is:

1. In a control device comprising a housing means, an electromagnetic means carried by said housing means, a movable valve means carried by said housing means and normally being disposed in a first operating position thereof and being adapted to be held in a second operating position thereof by said electromagnetic means as long as said electromagnetic means remains energized, electrical switch means carried by said housing means and being operatively interconnected to said electromagnetic means so that said electromagnetic means is adapted to be energized when said switch means is in a first operating condition thereof and is prevented from being energized when said switch means is in a second operating condition thereof, and a shift means carried by said housing means and being adapted to be axially moved from a first position thereof to a second position thereof so as to engage said valve means and move said valve means from said first operating position thereof to said second operating position thereof, the improvement wherein said shaft means has actuator means operatively interconnected to said switch means and is rotatably movable from a first rotatable position thereof to a second rotatable position therof to place and hold said switch means in said first operating condition thereof.

2. A control device as set forth in claim 1 wherein said switch means is in series with said electromagnetic means so that said electromagnetic means can not be energized if said switch means is in an open condition thereof.

3. A control device as set forth in claim 1 wherein said actuator means of said shaft means comprises cam surface means of said shaft means.

4. A control device as set forth in claim 1 and comprising a second valve means disposed in said housing means and being movable between a first operating position theeof and a second operating position thereof, said shaft means having second actuator means operatively interconnected to said second valve means and being rotatable from a certain rotatable position thereof to another rotatable position thereof to cause said second valve means to move from said first operating position thereof to said second operating position thereof.

5. A control device as set forth in claim 4 wherein said second actuator means comprises second cam surface means of said shaft means.

6. A control device as set forth in claim 4 wherein said first operating position of said second valve means is a closed position thereof and said second operating position of said second valve means is an open position thereof.

7. A control device as set forth in claim 4 wherein said second valve means comprises a pressure regulator valve means.

8. In a control system comprising a source of fuel, burner means, flame detecting means having means for generating an electrical current when sensing a flame at said burner means, and a control device for interconnecting said source to said burner means, said control device comprising a housing means, an electromagnetic means carried by said housing means, a movable valve means carried by said housing means and normally being disposed in a closed position thereof to prevent said source from reaching said burner means and being adapted to be held in an open position thereof by said electromagnetic means as long as electromagnetic means remains energized so that said source of fuel can be interconnected to said burner means, said flame detecting means being operatively interconnected to said electromagnetic means to direct said electrical current thereto to energize said electromagnetic means, electrical switch means carried by said housing means and being operatively interconnected to said electromagnetic means so that said electromagnetic means is adapted to be energized by said flame detecting means when said switch means is in a first operating condition thereof and is prevented from being energized by said flame detecting means when said switch means is in a second operating condition thereof, and a shaft means carried by said housing means and being adapted to be axially moved from a first position thereof to a second position thereof so as to engage said valve means and move said valve means from said first operating position thereof to said second operating position thereof, the improvement wherein said shaft means has actuator means operatively interconnected to said switch means and is rotatably movable from a first rotatable position thereof to a second rotatable position thereof to place and hold said switch means in said first operating condition thereof.

9. A control system as set forth in claim 8 wherein said switch means is in series with said electromagnetic means so that said electromagnetic means can not be energized if said switch means is in an open condition thereof, and a high temperature limit switch carried by said control device and being in series with said switch means and said electromagnetic means.

10. A control system as set forth in claim 8 wherein said actuator means of said shaft means comprises cam surface means of said shaft means.

11. A control system as set forth in claim 8 and comprising a second valve means disposed in said housing means and being movable between a first operating position thereof and a second operating position thereof, said shaft means having second actuator means operatively interconnected to said second valve means and being rotatable from a certain rotatable position thereof to another rotatable position thereof to cause said second valve means to move from said first operating position thereof to said second operating position thereof.

12. A control system as set forth in claim 11 wherein said second actuator means comprises second cam surface means of said shaft means.

13. A control system as set forth in claim 11 wherein said first operating position of said second valve means is a closed position thereof and said second operating position of said second valve means is an open position thereof.

14. A control system as set forth in claim 11 wherein said second valve means comprises a pressure regulator valve means for controlling the pressure of said fuel passing through said control device.

15. In a method of making a control device comprising a housing means, an electromagnetic means carried by said housing means, a movable valve means carried by said housing means and normally being disposed in a first operating position thereof and being adapted to be held in a second operating position thereof by said electromagnetic means as long as said electromagnetic means remains energized, electrical switch means carried by said housing means and being operatively interconnected to said electromagnetic means so that said electromagnetic means is adapted to be energized when said switch means is in a first operating condition thereof and is prevented from being energized when said switch means is in a second operating condition thereof, and a shaft means carried by said housing means and being adapted to be axially moved from a first position thereof to a second position thereof so as to engage said valve means and move said valve means from said first operating position thereof to said second operating position thereof, the improvement comprising the step of forming said shaft means to have actuator means operatively interconnected to said switch means and be rotatably movable from a first rotatable position thereof to a second rotatable position thereof to place and hold said switch means in said first operating condition thereof.

16. In a method of making a control system comprising a source of fuel, burner means, flame detecting means having means for generating an electrical current when sensing a flame at said burner means, and a control device for interconnecting said source to said burner means, said control device comprising a housing means, an electromagnetic means carried by said housing means, a movable valve means carried by said housing means and normally being disposed in a closed position thereof to prevent the fuel from said source from reaching said burner means and being adapted to be held in an open position thereof by said electromagnetic means as long as said electromagnetic means remains energized so that said source of fuel can be interconnected to said burner means, said flame detecting means being operatively interconnected to said electromagnetic means to direct said electrical current thereto to energize said electromagnetic means, electrical switch means carried by said housing means and being operatively interconnected to said electromagnetic means so that said electromagnetic means is adapted to be energized by said flame detecting means when said switch means is in a first operating condition thereof and is prevented from being energized by said flame detecting means when said switch means is in a second operating condition thereof, and a shaft means carried by said housing means and being adapted to be axially moved from a first position thereof to a second position thereof so as to engage said valve means and move said valve means from said first operating position thereof to said second operating position thereof, the improvement comprising the step of forming said shaft means to have actuator means operatively interconnected to said switch means and be rotatably movable from a first rotatable position thereof to a second rotatable position thereof to place and hold said switch means in said first operating condition thereof.

17. In a control device comprising a housing means, an electromagnetic means carried by said housing means, a movable valve means carried by said housing means and normally being disposed in a first operating position thereof and being adapted to be held in a second operating position thereof by said electromagnetic means as long as said electromagnetic means remains energized, a pressure regulator valve means carried by said housing means, and a shaft means carried by said housing means and being adapted to be axially moved from a first position thereof to a second position thereof so as to engage said movable valve means and move said movable valve means from said first operating position thereof to said second operating position thereof, the improvement wherein said shaft means has actuator means operatively interconnected to said regulator valve means and is rotatably movable from a first rotatable position thereof that holds said pressure regulator valve means in a closed condition thereof to a second rotatable position thereof that places said pressure regulator valve means in an operating condition thereof.

18. A control device as set forth in claim 17 wherein said actuator means of said shaft means comprises cam surface means of said shaft means.

19. A control device as set forth in claim 18 wherein said actuator means of said shaft means comprises a lever having opposite ends and being pivotally mounted to said housing means intermediate said ends thereof, one of said ends of said lever being in engagement with said cam surface means and the other of said ends of said lever being engagable with said pressure regulator valve means.

20. In a method of making a control device comprising a housing means, an electromagnetic means carried by said housing means, a movable valve means carried by said housing means and normally being disposed in a first operating position thereof and being adapted to be held in a second operating position thereof by said electromagnetic means as long as said electromagnetic means remains energized, a pressure regulator valve means carried by said housing means, and a shaft means carried by said housing means and being adapted to be axially moved from a first position thereof to a second position thereof so as to engage said movable valve means and move said movable valve means from said first operating position thereof to said second operating position thereof, the improvement comprising the step of forming said shaft means to have actuator means operatively . interconnected to said pressure regulator valve means and be rotatably movable from a first rotatable position thereof that holds said pressure regulator valve means in a closed condition thereof to a second rotatable position thereof that places said pressure regulator valve means in an operating condition thereof.

* * * * *